United States Patent [19]

Sommer et al.

[11] Patent Number: 4,575,324

[45] Date of Patent: Mar. 11, 1986

[54] ROTARY FLUID PUMP

[75] Inventors: Manfred Sommer, Untergruppenbach-Vorhof, Fed. Rep. of Germany; A. Robert Gudheim, Petersham, Mass.

[73] Assignee: Sine Pumps, N.V., Curacao, Netherlands Antilles

[21] Appl. No.: 612,615

[22] Filed: May 21, 1984

[30] Foreign Application Priority Data

May 21, 1983 [DE] Fed. Rep. of Germany ..... 3318631

[51] Int. Cl.[4] ..... E04C 2/00

[52] U.S. Cl. ..... 418/217

[58] Field of Search ..... 418/152, 178, 179, 215–219, 418/228, 229, 232, 233, 248

[56] References Cited

U.S. PATENT DOCUMENTS

| | | | |
|---|---|---|---|
| 805,140 | 11/1905 | Jarvis | 418/216 |
| 1,690,728 | 11/1928 | Jaworowski | 418/216 |
| 2,966,860 | 1/1961 | Maynard | 418/152 |
| 3,838,954 | 10/1974 | Rapone | 418/218 |
| 4,028,028 | 6/1977 | Fuchs | 418/219 |

FOREIGN PATENT DOCUMENTS

| | | | |
|---|---|---|---|
| 2641451 | 7/1980 | Fed. Rep. of Germany . | |
| 8001935 | 9/1980 | PCT Int'l Appl. | 418/219 |

*Primary Examiner*—Leonard E. Smith
*Assistant Examiner*—Jane E. Obee
*Attorney, Agent, or Firm*—Robert E. Burns; Emmanuel J. Lobato; Bruce L. Adams

[57] ABSTRACT

A rotary fluid pump has a rotor with a sinusoidal, undulating, vane projecting radially from a hub portion rotatable in a pump chamber having a suction chamber, discharge chamber and a transport zone extending circumferentially from the suction chamber to the discharge chamber. The transport zone has a cylindrical inner periphery which is slidably engaged by the periphery of the rotor vane and opposite planar end walls slidably engaged by crests of the undulating vane. Between the suction chamber and the discharge chamber there is a gate assembly with two sliders engaging opposite sides of the vane respectively and interconnected by a bow spring so that they move together. The gate assembly, rotor and casing parts forming the pump chamber are all contained in a cylindrical outer housing, from which they are easily removed for cleaning, inspection and replacement. The sliders have round noses and the rotor vane is formed with varying thickness to provide contact of the sliders with all portions of opposite surfaces of the vane. This is achieved by contouring the surfaces by a tool having the same radius as that of the slider noses.

11 Claims, 19 Drawing Figures

FIG. 5
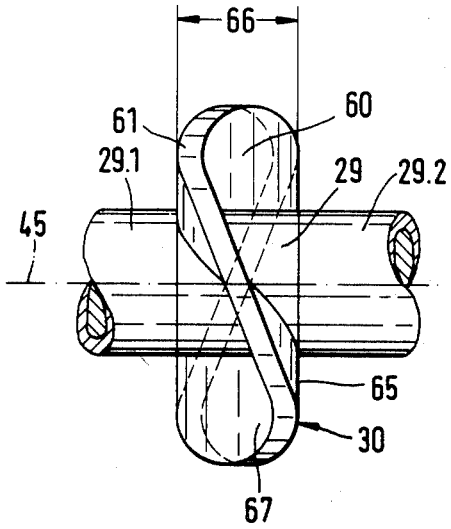
FIG. 7
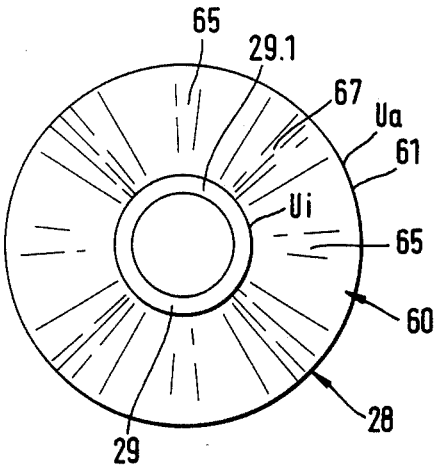
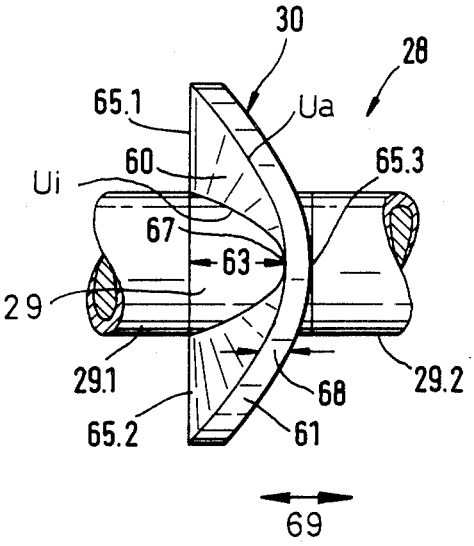
FIG. 6

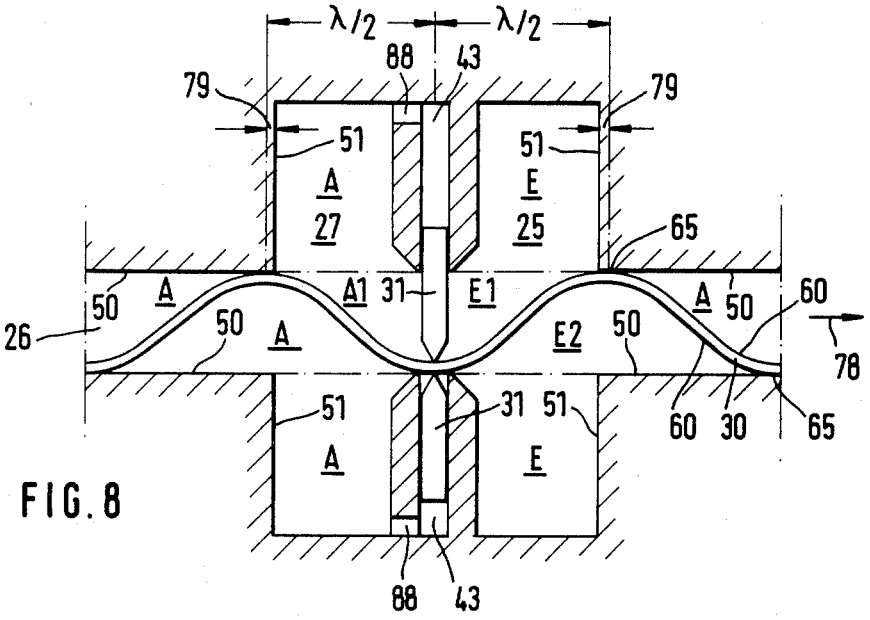
FIG. 8
FIG. 9
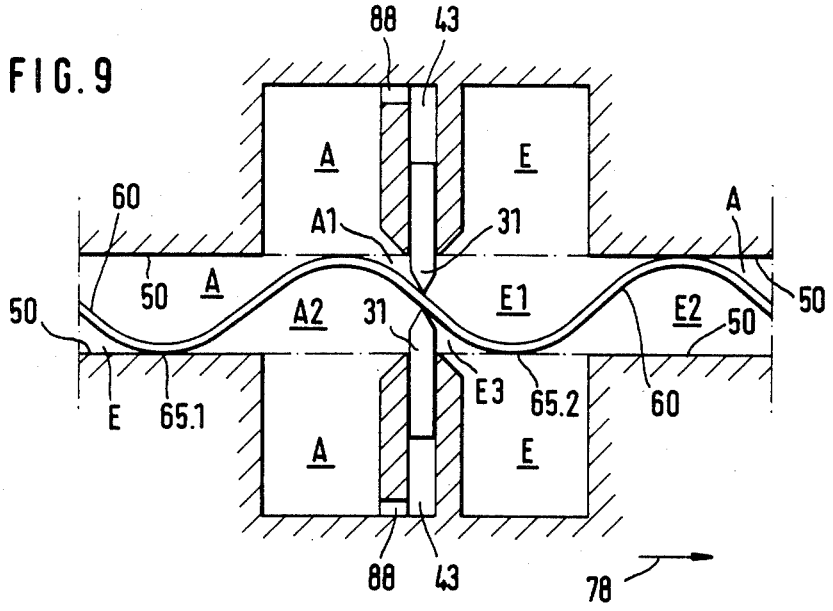

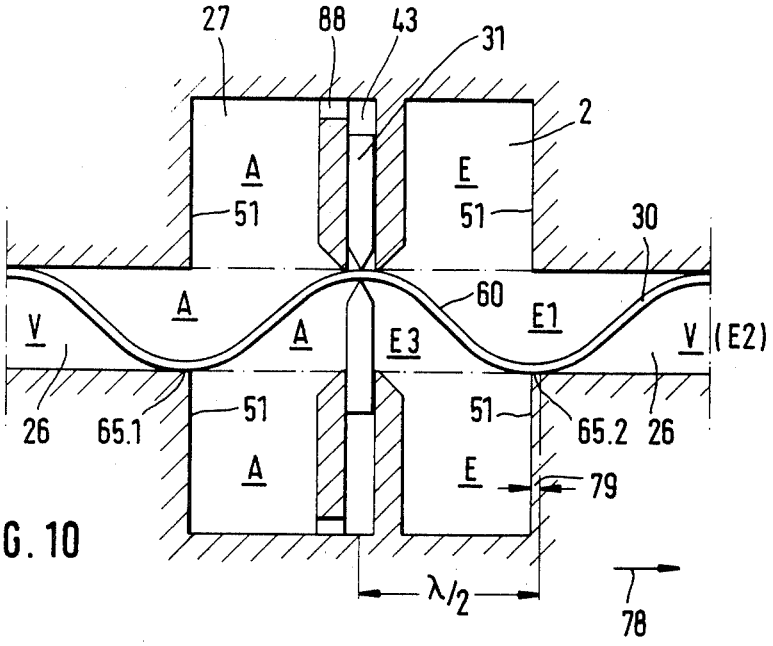
FIG. 10
FIG. 11
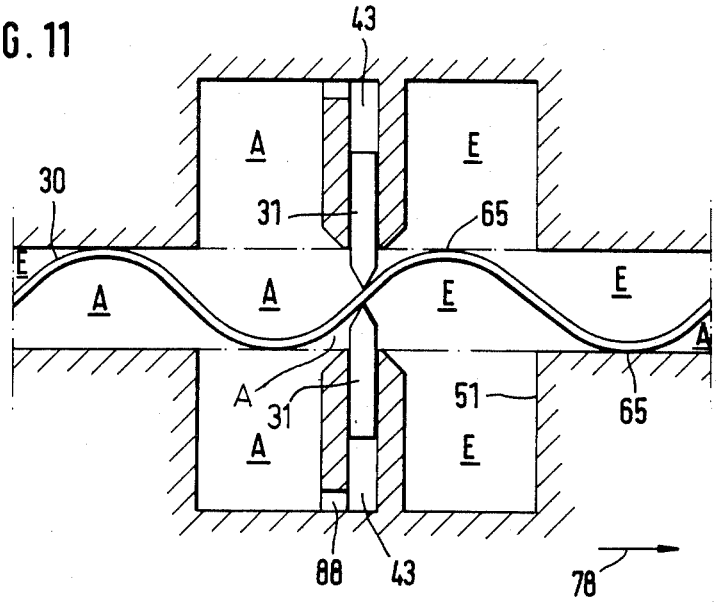

ROTARY FLUID PUMP

FIELD OF INVENTION

The present invention relates to a rotary fluid pump of the kind in which a rotor rotating in a cylindrical pump chamber having planar end walls comprises a hub portion and an undulating vane portion which extends radially of the hub and has an outer periphery in sliding engagement with the inner periphery of the pump chamber and crests of undulations in sliding contact with opposite end walls of the pump chamber to form a plurality of pockets for transporting fluid from an inlet to an outlet which are separated from one another by reciprocable gate members in sliding engagement with opposite faces of the vane portion of the rotor.

BACKGROUND OF THE INVENTION

Pumps of this general character have been proposed more than 100 years ago. For example in Ortmans German patent No. 1123 (1877), there is disclosed a rotary pump having a cylindrical body with plane end walls and suitable inlet and outlet pipes. At each of the two sides there is a gland through which extends a shaft on which there is a cast iron disc. The disc is formed of two spiral surfaces which are arranged symmetrically so that they lie one within the other and represent a waveform surface of which the convex parts alternately remain in contact with the two end walls of the pump body. This spiral disc extends from its hub on the shaft to the periphery of the pump housing on which it tightly slides and by means of its position in the housing forms separate compartments. In order to avoid back flow of the fluid which moves with the rotating spiral disc, a a barrier slider is provided between the inlet and outlet openings. The slider comprises a plate provided with a slot perpendicular to the axis of the pump which accommodates the disc. Alternatively the slider comprises two hollow movable plates which are pressed by springs in the direction of the slot accommodating the disc. The spiral disc is gripped in the slot or between the two plates, which are pressed toward one another by the springs, and can move freely through the slot by reason of its uniform thickness and continuous surfaces and thereby automatically imparts a back and forth movement to the sealing slider.

Although pumps of this kind have important advantages over other types of pumps in that they are positive displacement rotary pumps requiring no valving, they have not come into use. This appears to be due to the fact that they present problems which have not been solved or perhaps even recognized. A primary problem is that of providing a fluid-tight engagement between nose portions of the sliders and the disc or rotor. This problem is more complex than may at first appear. Assuming that the rotor comprises a central hub portion from which an undulating vane portion extends radially, the undulations must have the same depth in an axial direction adjacent the hub as at the outer periphery of the rotor. However, the circumferential extent of the vane portion is much less adjacent the hub than at the periphery. This means that the slope of those portions of the undulations between the crests and bottoms of the undulations is steeper adjacent the hub than at the periphery. In fact, the steepness of the slope increases continously from the periphery of the vane to the hub.

If it is assumed that the noses of the sliders are knife edges which are radial and perpendicular to the axis of rotation of the rotor and that it is desired to maintain a constant spacing between the sliders, the opposite surfaces of the vane portions of the rotor will be perpendicular to the central plane of the sliders when, and only when, the sliders are at one of the crests of the undulations. At the crests, the thickness of the vane portion is equal to the spacing of the slider. In all other portions, the surfaces of the vane portion are not perpendicular to the central plane of the sliders and hence, if the spacing of the sliders is to be maintained constant, the thickness of the vane portion of the rotor must vary in accordance with the slope of the vane surfaces with respect to the central plane of the slider. This results in the thickness of the vane, at any given distance from the axis, being a minimum midway between opposite crests of the vane. Moreover, except at the crests of the undulations, the thickness must decrease from the periphery of the vane portion inwardly to the hub. The required configuration of the vane portion of the rotor is thus quite complex.

Moreover, from a practical point of view the noses of the sliders cannot be knife edges. If the noses of the sliders were sharp they would cause rapid wear of the rotor. Moreover, even if the noses of the sliders were initially knife edges they would quickly become blunted by wear. Moreover, it has been found that the pump will not "wear in" in the sense of the sliders and rotor wearing so as to conform to one another to provide a fluid tight engagement of the sliders with the rotor. Since the angle of engagement of the undulating vane with the sliders continually varies not only circumferentially but also radially, wear at one point results in non-engagement and hence leakage past the sliders at other points.

Since knife edges are undesirable from the point of view of wear and moreover, cannot be maintained the nose portions of the sliders must in practice be rounded. This complicates the problem of maintaing a fluid tight engagement of the sliders with the undulating vane portion of the rotor. Except at crests of the undulations, the line of engagement is no longer a line which is radial and perpendicular to the rotor and in fact is no longer a straight line but rather a three dimensional curve which varies from point to point. In order to provide a fluid tight engagement with the sliders, the contour of the surfaces of the undulating vane portion of the rotor must be modified to take into account the radius of the nose portion of the sliders.

A further problem in a rotary pump of this kind is to provide fluid tight contact between the rotor and the walls of the pump chamber. If fluid tight contact is not maintained, fluid leaks past the contact lines and the efficiency of the pump is decreased. Even though the pump is initially "tight", clearance develop sooner or later through wear of the parts. This is especially serious when pumping low viscosity fluids.

SUMMARY OF THE INVENTION

It is an object of the present invention to provide a positive displacement rotary fluid pump which overcomes the objections that have heretofore prevented pumps of this type from coming into use. In accordance with the invention, the nose portions of the sliders are rounded with a predetermined radius of curvature and the opposite surfaces of the undulating vane portion of the rotor are designed as a function of the amplitude of the undulations (movement of the sliders), the number of undulations for revolution (at least two), the radius of the nose portions of the sliders and the radius of each incremental portion of the surface (distance from the axis of rotation). Such surface can be produced by a computerized shaping or milling machine programmed to take these parameters into account. However, a practical and economical method of producing the rotor is to cast its approximate shape and then finish the vane portions of the rotor by means of a cylindrical milling cutter or other tool of the same radius as the nose portions of the sliders. The cutter is mounted with its axis of rotation perpendicular to the axis of rotation of the rotor and, as the rotor is rotated the cutter is reciprocated axially of the rotor in timed relation with the rotation of the rotor so as to make at least two complete strokes for each rotation of the rotor. By means of two cutters spaced apart a distance equal to the desired spacing of the sliders, both surfaces of the vane can be machined simultaneously. Alternatively the two sides can be machined individually, care being taken that the timing of the reciprocation of the tool when machining the second surface is exactly 180° from the first. Instead of producing each rotor in this manner "copies" can be produced by molding or die casting after a "master" has been produced in the manner described. There is thus provided a rotor which maintains fluid-tight contact between the rotor and the sliders throughout the entire circumferential extent of the rotor.

In accordance with the present invention the efficiency of the pump is maintained by constructing the pump in such manner that worn parts can be easily, quickly and inexpensively replaced. The pump chamber is defined by complementary casing parts held in assembled relation solely by a shell into which they snugly fit. If parts become worn, they can be replaced merely by opening the shell, removing worn parts and replacing them by new or recondition parts. Moreover, the ease of disassembly of the pump makes it advantageous for use in industries such as the food industry where frequent disassembly for cleaning is required. A further factor contributing to long life and continued efficiency of the pump is the selection of materials. Thus, the rotor is preferably made of harder and more wear resistant material than the sliders and the casing parts which can easily be replaced. The ready replacement of parts has the further advantage that a pump can quickly be changed for other uses. For example when pumping low viscosity fluids, the casing parts defining the pump chamber are preferably made wholly or in part of elastomeric material of such hardness that it can be indented slightly by the crests of the undulations of the vane portion of the rotor thus in effect providing a tight seal by "negative clearance". The hardness may, for example, be 60 to 90 Durometer.

BRIEF DESCRIPTION OF DRAWINGS

Other objects and advantages of the invention will appear from the following description of preferred embodiments shown by way of example in the accompanying drawings in which:

FIG. 5 is a side view of the rotor with adjacent shaft portions, FIG. 6 is a further side view of the rotor turned 90° from the position shown in FIG. 5, FIG. 7 is a front view of the rotor shown in FIG. 5, FIG. 8 is a schematic developed view of the pump chamber, rotor and sliders shown in a position in which the sliders engage a crest of the undulating vane portion of the rotor, FIG. 9 is a similar schematic developed view in which, however, the rotor is displaced $\lambda/4$, FIG. 10 is a similar schematic developed view but with the rotor displaced $\lambda/2$, FIG. 11 is a similar schematic developed view but with the rotor displaced $3\lambda/4$.

DESCRIPTION OF PREFERRED EMBODIMENTS

Figure 1:
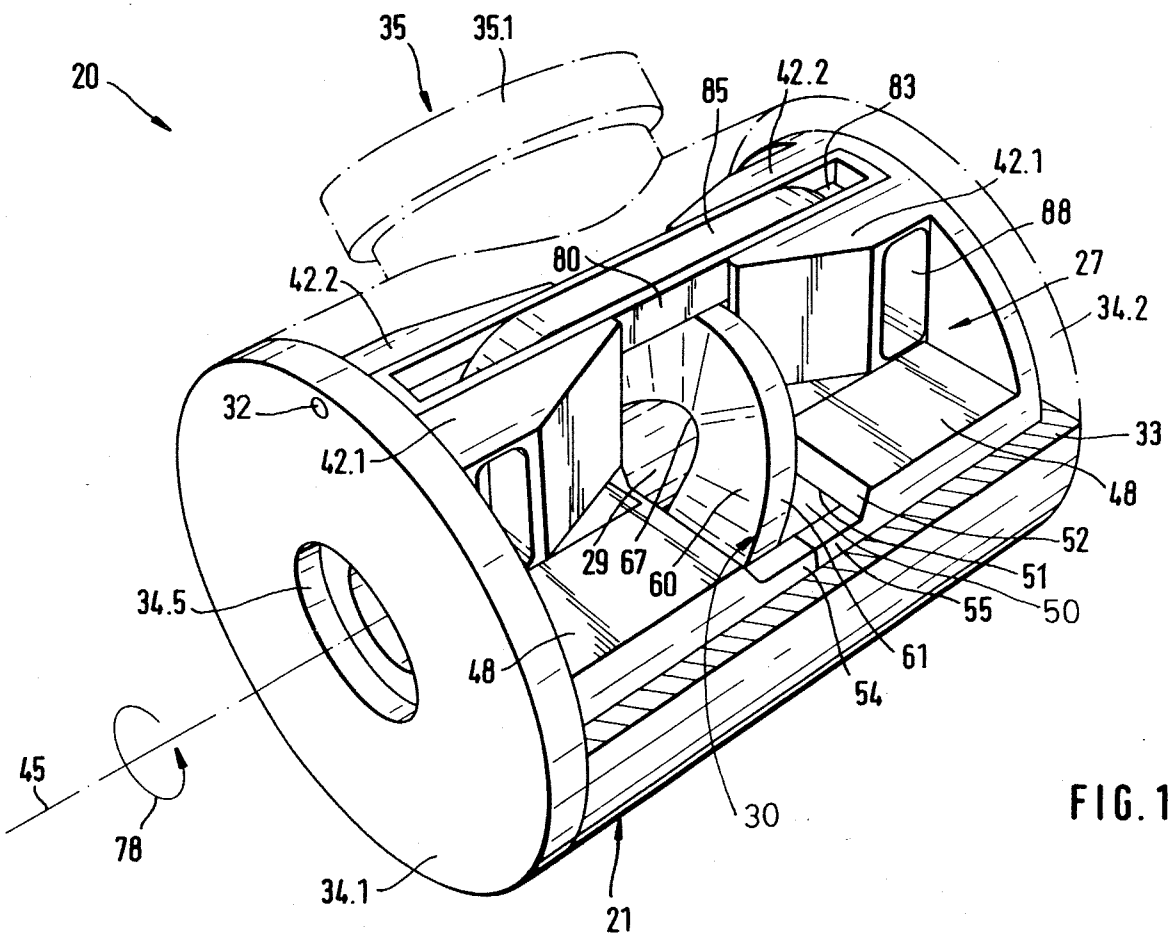
FIG. 1 is a perspective view of a pump in accordance with the present invention portions being broken away to show interior construction.

In FIGS. 1 to 11 of the drawings there is shown a pump 20 having an outer shell or housing 21 with an inlet and outlet 23. A pump chamber 24 having a suction chamber 25, transport zone 26 and discharge chamber 27 is formed in the housing. A rotor 28 is rotatable in the housing. The rotor has a hub 29 and a radially projecting vane or pump element 30. Moreover, sealing sliders 31 are provided between the suction chamber 25 and the discharge chamber 27.

The housing 21 comprises an annular cylindrical housing mantle 33 and two housing covers 34.1 and 34.2 which are set at the ends of the housing mantle 33 and are secured thereto in a manner not otherwise shown. Centering pins 32 are indicated. A cylindrical inlet nipple 35 for the inlet 22 and a cylindrical outlet nipple 36 in an upper region of the housing mantle are provided with threads 35.1 and 36.1 for connection of intake and discharge conduits. They have a cylindrical inlet bore 35.2 and a cylindrical outlet bore 36.2 respectively. These are midway between the ends of the housing mantle 33 and have corresponding openings in the housing wall which open into the suction chamber 25 and the discharge chamber 27. The suction chamber 25 and the inlet 22 represent the suction side and the discharge chamber 27 and outlet 23 represent the pressure side of the pump.

The housing cover 34.1 has a central bore 34.5 to receive a drive shaft. This central bore 34.5 is surrounded inwardly by a bearing shoulder 41 which is formed on the housing cover 34.1 and in its upper region merges into slider guides 42.1 and 42.2 which between them define the slider slot 43 which opens downwardly into the bearing bore 44. These parts are made of metal, for example stainless steel or brass. The housing cover 34.2 is basically similar but advantageously is formed integrally with the housing mantle 34 or is permantely secured to it by welding or otherwise. It requires no central bore 34.5 for reception of a drive shaft but can, however, have a recess closed by a cover which is not further represented. Also, it carries a bearing shoulder 41 which merges into the slider guides 42.

Figure 2:
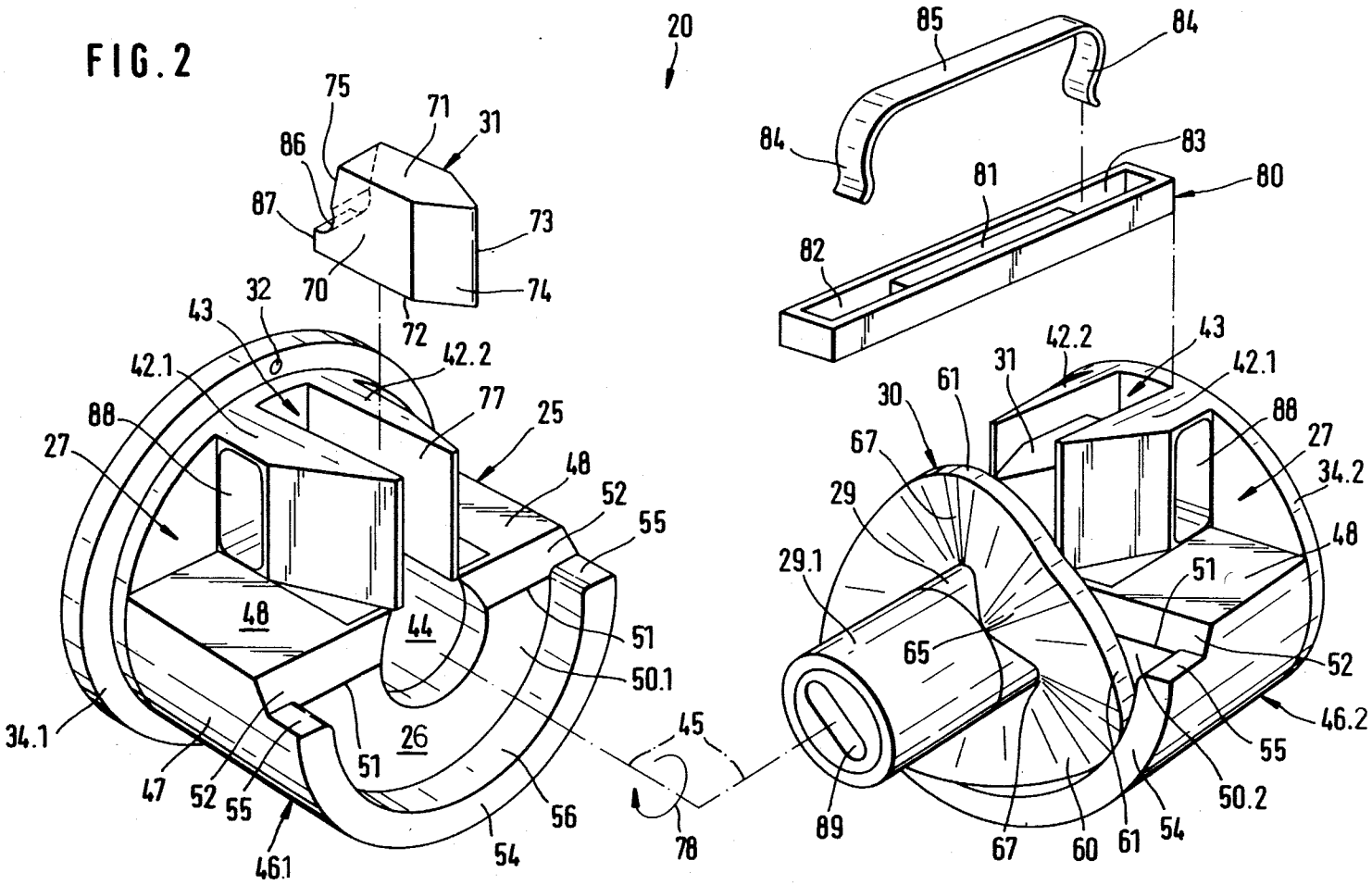
FIG. 2 is an exploded perspective view of a partially disassembled pump without the outer housing or shell.
Figure 3:
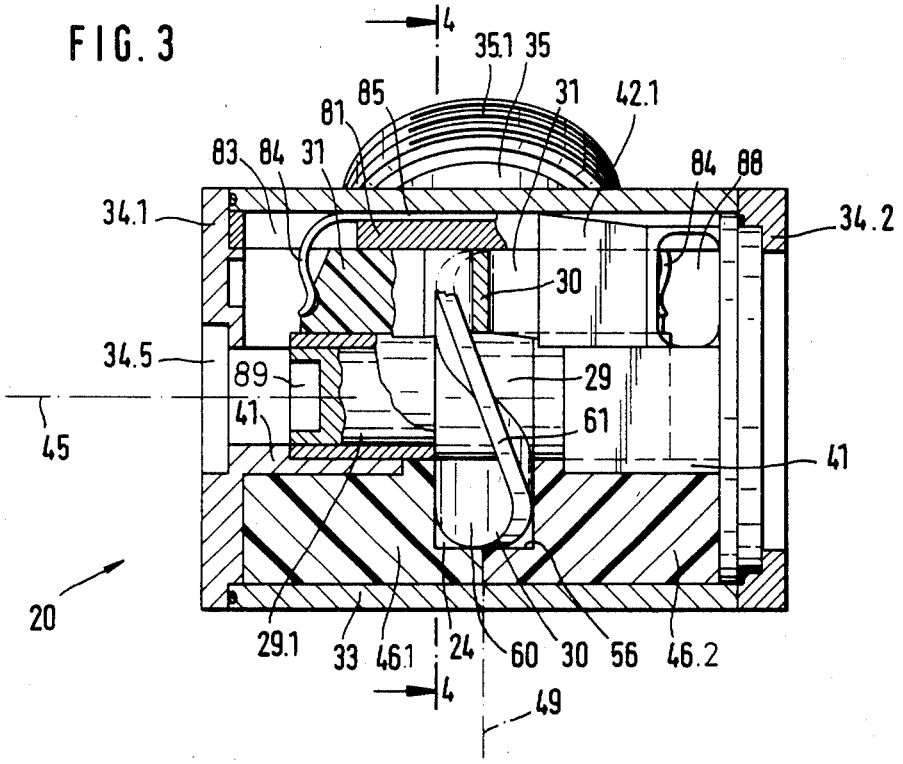
FIG. 3 is a vertical longitudinal section of the pump.

In the bearing shoulders 41, the rotor 28 is supported by bearing ends 29.1 and 29.2 of the hub 29, which, with a corresponding slide bearing fit, are therein rotatably supported and, if necessary, can be formed with bearing bushings or the like. Surrounding the bearing holders 41 up to about the pump axis 45 are inserted interchangeable casing parts 46.1 and 46.2 of a suitable plastic or rubber material. These are formed outwardly with a surface 47 fitting in the housing mantle 33 and extend up to a surface 48 which defines the suction chamber 25 and the discharge chamber 27. Each interchangeable casing part 46.1 or 46.2 extends to a central plane 49 which is shown in FIG. 3. There the two parts divide and are thereby inserted as like mirror image parts whereby special production and assembly advantages are obtained. They define together the pump chamber 24 through end faces 50.1 and 50.2 which are equally spaced from the central plane 49 and are disposed parallel to one another and define the transport zone 26 of the pump chamber 24. Their upper end edges 51 lie somewhat above the pump axis 45 as seen in particular in FIG. 4. Here the end edge 51 for reasons of production and symmetry is offset parallel to the diameter although it can also be radial. It must in any case throughout its entire length run slightly above the diameter of the housing in order to assure sufficiently sealing. As clearly seen in FIG. 2, it ends in an inclined face 52 which provides a transition to the surface 48 and makes possible easy production of the plastic or metal part. Joining the pump channel end face 50 is a ring part 54 which surrounds the transport zone 26 and is formed integrally with the interchangeable part 46. As shown in FIG. 2 it extends slightly above the end edges 51 in the end surface 55 and forms or limits the cylindrical inner circumferential surface 56 of the transport zone 26 of the pump channel 24. As the interchangeable part 46 is formed of a suitable plastic material there are provided good, low friction, slightly elastic surfaces.

The rotor 28 with the hub 29 and the bearing ends 29.1 and 29.2 carries in the middle a radially projecting pump element 30 surrounding the hub 29. This is formed as a shaped element with wave form boundary surfaces. It comprises a thin sinusoidal vane or web projecting radially from the hub. It has an outer circumference 61 which is cylindrical and exactly conforms to the inner surface 56 of part 47 on which it slides. The contoured surfaces 60 on opposite sides of the pump element 30 are spaced from one another and are so formed that the outer circumferential surface 61 is a sinusoidal band. Both of the contoured surfaces 60 in their development are formed as a sine function in which the amplitude 63, as best seen in FIG. 6, is the same at all distances from the axis of rotation of the rotor. As the circumferences increase with the outwardly increasing diameters, the sinusoidal curve continually becomes flatter radially outwardly whereby the spacing 68 of the two boundary surfaces in the direction of the axis 45 would be the same for knife sharp sealing sliders 31 in all positions. Such a pump element can be produced by computerized profile milling or profile planning or by casting. The pump element, on account of its favorable form, requires only few moving sealing parts since its inner circumference is fixed on the hub 29 and its outer circumferential surface 61 sidably engages the surface 56 in the pump channel 24, and thus with only its boundary surfaces 60 requiring sealing.

For sealing the boundary surfaces 60, there are provided sealing sliders 31 between the inlet and outlet and pump chamber end faces 50 in the transport region 26. The latter are, for example, plane faces perpendicular to the pump axis 45 the spacing of which is determined by the width of the inner circumferential surface 56 of the ring part 54 which corresponds exactly to the spacing 66 of the highest portion 65 of the boundary surfaces 60 on opposite sides of the pump element 30 as clearly seen in FIGS. 5 and 6 so that the crest lines of the sinusoidal form curved surfaces lie as straight sealing edges on the pump channel end faces 50.1 and 50.2 and thereby provide a seal as is described further below. If, as illustrated in the drawings, the noses of the sliders are theoretically sharp, a straight line which is perpendicular to the pump axis 45 and axially movable through a stroke 63 is selected as the generatrix of the boundary surfaces. However, as will be described below, the noses of the sliders in practice are arcuate in cross section and the genetrices of the boundary surfaces are cylinders having the same radius as the noses of the sliders. The pump channel end faces 50.1 and 50.2 have a circumferential extent somewhat more than 180° so that with the selected number of two wavelengths in one circumference, the two highest portions 65 on one side of the pump element 30, when one has just left the suction chamber 25 and the other is shortly before the entrance in the discharge chamber 27, are approximately on the horizontal diameter and consequently fully seal and limit the enclosed volume.

For sealing the regions not in contact with the pump channel end surfaces 50 namely between the suction chamber 25 and the discharge chamber 27 sealing sliders 31 are provided. These are basically in the form of parallelapiped elements as can be seen from FIG. 1. They have side bearing and sliding faces 70, an upper face 71 of which the radius corresponds to the outer circumferential surfaces 61, an under sliding surface 72 with a radius corresponding to that of hub 29, and inclinded faces 74 forming a sealing edge 73, and a stepped back surface 75. With the side sliding surfaces 70, the sealing slider fits slidably in the slider slot 43 and fits the slide surfaces 77 of the slider holder 42. The lower slide surface 72 has a sealing engagement with the hub 29 or the bearing ends 29.1, 29.2. As seen in FIGS. 1 and 2, the slide holders 42 are higher than the outer circumferential surface 61 of the pump element 30 by the thickness of the ring part 54. This intermediate space is to be bridged over. For this purpose there is provided an elongate insert part 80 which has width of the slider slot 53 and a total length which approximately corresponds to the total length of two sealing sliders 31 plus the thickness of the pump element 30. It has, in the middle, a connecting web 81 and at the top an elongate recess 82 with two through-openings 83. Through these extend the spring ends 84 of a bow spring 85 which works in the manner of a leaf spring as a pressure-exerting tension spring with the spring ends 84 engaged in recesses 86 in the profiled back surfaces 75 of the sealing sliders 31. A projection 87 is, if necessary, provided as an additional stroke limiting device.

In each of the slider holders 42, a through opening 88 leads from the discharge chamber 27 to the slider slot 43 rearwardly of the slider so that the medium being pumped presses on the sealing slider 31 from behind and thereby presses its sealing edge 73 against the boundary surface 60. The spring 85 which presses the two sliders 31 against the boundary surfaces 60 of the rotor to compensate for wear and to provide good sealing is thus reinforced. Moreover, the opening 88 provides for the escape of fluid when the slider is moved rearwardly, i.e. away from the central plane of the rotor, and thereby avoids the build-up of excessive pressure in the space behind the slider.

The form of the pump element 30 with the two boundary surfaces 60 is seen clearly from FIGS. 1 to 3. Moreover, in FIGS. 5 to 7, in which only the rotor 28 with the hub 29 and portions of the bearing ends 29.1 and 29.2 are shown, the pump element 30 on hub is seen in three different views. In particular from FIG. 6 it is seen that the boundary surfaces 60 at the outer circumference Ua are essentially flatter than at the inner circumference Ui where they have the steepest contour. As here the sine function, contrary to usual plane representation, deviates from circle to circle, there results a surface form which is difficult to represent in which the ordinate which corresponds to the stroke 63 of the boundary surface 60 or of the sliders 31 remains the same over the entire radius of the boundary surface and must remain the same for the rigid sealing slider 31 and the abscissa of the angle function varies according to the radius from the smallest circumference Ui to the largest circumference Ua, becoming continually larger so that the surface becomes flatter. The steepest curve region occurs in the region of the inner circumference Ui and the steepest portion 67 is seen in the middle of FIG. 6. The trace of the curve is determined through selection of the diameters and thereby the circumferences and the number of waves, so that taking into account the coefficient of friction of the material of the pump element 30 and the sealing slider 31 or the sealing edge, and the medium to be pumped, no self-locking occurs which would subject the slider to strong side forces. As will be seen, there are two wave lengths provided in the circumference whereby there are provided two highest positions 65.1, 65.2 65.3 and 65.4 on each side of the pump element which are opposite the deepest portions 67 of the other boundary surface. With the curve shown here with ideal knife-sharp sealing edges 73 of the sealing sliders 31, the spacing 68 in an axial direction remains constantly the same in all positions of the boundary faces 60. In practice, the sealing edges 73 are rounded or through wear become rounded and the curved faces of the pump element are either correspondingly corrected or properly ground or machined as described below in order to obtain an ideal sealing relationship.

FIGS. 8 to 10 are schematic developed views showing the mode of operation of the pump. The views are take approximately in the middle of the boundary surfaces 60 between the inner circumference Ui and the outer circumference Ua of the pump element 30. It is also shown how, through the through-hole 88, the pressure in the outlet A or 27 applies pressure behind the sealing slider 31 in the slider slot 43 to press the sealing slider against the boundary surfaces 60.

It is also seen from FIGS. 8 to 10 how, through movement of the pump element 30 in the direction of the arrow 78 the chambers on both sides of the pump element 30 are successively filled and emptied. The chambers bounded by the boundary surfaces 60 are designated by the letters E and A in order to show which regions are in connection with the suction chamber 25 or inlet 22/E and which regions are in connection with the discharge chamber 27 or outlet 23/A. The letter V designates the chamber between the boundary surfaces 60 and the pump channel end faces 50 in the condition in which the two highest positions 65 seal directly on the both sides on the respective pump channel end surfaces 50 and thereby transport a separate enclosed volume of medium without further filling or emptying from the inlet to the oulet. This condition exists only so long as a crest of the rotor is in the rotary position between the horizontal diameter and the upper end edge 51. In all other conditions, as will be seen, the chambers on both sides of the pump element 30 are connected either with the inlet chamber E or the outlet chamber A.

Figure 4:
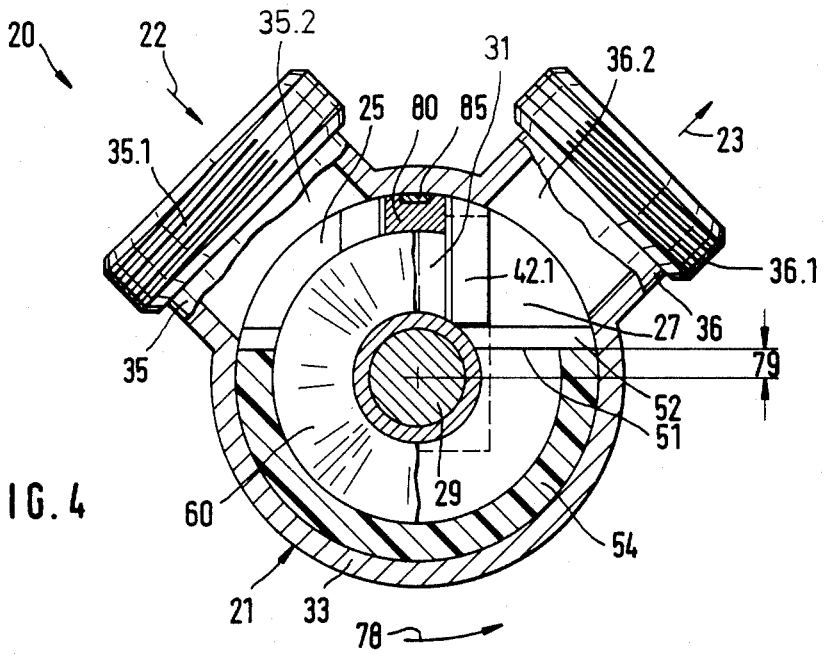
FIG. 4 is a vertical cross section taken approximately on the line 4—4 in FIG. 3.

As the outer circumferential surface 61 is in sealing enagement with the inner circumferential surface 56 and the chamber is limited inwardly by the hub 29, there is no connection in an intermediate position between the outlet and inlet. On the other hand, through favorable profiling, unnecessary travel is spared for, as seen in FIGS. 8 to 11, the inlet and outlet regions take almost half a wave length with only a narrow overlap 79 for sealing, since the edge 51 lies somewhat above the horizontal diameter as shown in FIGS. 2 and 4. It is schematically indicated in FIGS. 8 to 11 and represents the limit of inlet E or outlet A and thereby the sealing edge or guiding edge for limiting the respective closed transport volume V. As it is offset parallel to the diameter and the highest positions 65 are exactly radial, the opening of the enclosed volume V in the transport zone takes place first during the sweep of the overlap 79 with an initial very small triangular opening and then gradually enlarges whereby a shock-free pressure equalization occures. As seen from FIGS. 8 to 11, it is very significant that the inlet and outlet lie respectively on both sides of the pump element 30 and also with both sides constantly connected. However, as the pump element 30 is a wave form collar-like part, the chamber on one side during rotation of the pump element continually increases or decreases while the chamber on the other side by a like volume decreases or increases. Hence there is a constant equal inflow and outflow of the medium being pumped. When the volume increment on one side becomes smallest and the medium passes over into the enclosed region V, the maximum possible amount flows on the other side and vice versa. Directly thereafter, the chamber V opens with limited flow to the outlet A/23/27 through which the medium flows with greatest volume out of the region A on the other side.

The operation of the pump is as follows:

To the inlet 22 there is connected a suction line which is connected with or filled with the medium to be pumped. To the outlet 23 there is connected a pressure hose which carries away the medium to be pumped. When the rotor is turned in the direction of the arrow 78 by a motor which engages a drive slot 89 in the rotor, the rotor 28 with hub 29 and pump element 30 move toward the right in the schematic developed views of FIGS. 8 to 11. In FIG. 8, the chamber E1 is just in the condition of maximum inflow while the chamber E2 is completely filled and henceforth moves in front of a surface area of the boundary surface 60 of the pump element without further filling until the highest position 65.2 reaches the upper end edge 51 and then the closed condition V prevails which, in FIG. 10, also bears the designation (E2) in order to indicate which volume part is here enclosed. In the meantime, chamber E3 is filled as seen in FIG. 9, beginning slowly while the chamber E1 is filled with a limited volume part. Correspondingly, at the same time, the largest volume part will be pressed out of the chamber A1 each time unit while the chamber A2 begins to partake in pressing out the medium with the smallest volume part each time unit. It will be seen that as the volume part in each time unit decreases in amount on one side, it increases on the other side. The sealing sliders 31 separate the inlet E from the outlet A and in front of them the medium is pressed into the outlet. The discharge pressure is applied through the openings 88 in the slider slot 43 and presses the sealing sliders 31 firmly against the boundary faces 60. Moreover, they are pressed toward one another by the bow spring 85 and consequently are pressed on the boundary faces 60. Through the sinusoidal movement of the boundary faces 60 and of the pump element 30, sealing sliders 31 are automatically moved back and fourth whereby they carry out a sinusoidal movement which leads to a progressive decrease and increase in velocity with limited acceleration in the end positions so that there is no danger of the sliders lifting off by reason of inertia.

The small sliding surfaces are easy to control and therefore guarantee a pump with limited losses. It can be driven as a low speed and also as a high speed pump according to the construction, design, and the medium to be pumped. The pump is especially suitable for the food industry because it can be made of corrosion resisting material, for example bronze, stainless steel or plastic. Also, parts of the rotor or only the sealing faces can be made of suitable plastic or elastomeric material.

Also the sealing edges or the like on the sealing sliders 31 can be coated with a corresponding material or can be made of sintered or ceramic material. The pumps are therefore especially suitable for the food industry and for other media containing delciate components and thick material because there are no parts having a swinging or flapping movement which, together with other pump parts in most pumps, tend to crush and damage sensitive components of the medium being pumped. In the simple construction with no valves and only a single one-piece rotating part and with only one sealing slider on each side, and the easily disassembled construction with replacement parts, there is provided a pump with a high capacity and simple construction as well as reliable operation.

In the illustrated embodiment, the sealing sliders 31 are made wholly of plastic material with a knife sharp sealing edge 73. In practice, the sealing edge would be somewhat rounded and the boundary faces 60 would be correspondingly corrected as described below. When better sealing between the inlet and outlet is desired, in particular to attain higher pressure, more than one slider, for example two or three sliders, can be arranged next to one another.

Also, more than two wave lengths in the circumference can be provided. Then, the volume part enclosed in the region V is transported over a greater distance and there can be more than one sealing part on the highest portions 65 for each wave length on the pump channel infaces whereby loss through back flow is limited.

In the illustrated embodiment the simplest and theoretical form, namely a straight line which is perpendicular to the pump axis 45, is described as being used as the generatrix for the boundary surfaces. If need be, this straight line can be inclined or the generatrix can be given a suitable profile which can be selected according to the flow relationships and the requirements of the sealing slider form. Inlet and outlet regions and openings can be made larger or smaller according to the intended use of the pump. The here selected advantageous embodiment provides for the largest possible inlet and outlet cross section relative to the wave length which without lost space and enlarging the pump dimensions, realizes optimal flow relationship and connection conditions. The cross section of the connections and the provisions for securing the conduits can be formed and profiled otherwise.

Figure 12:
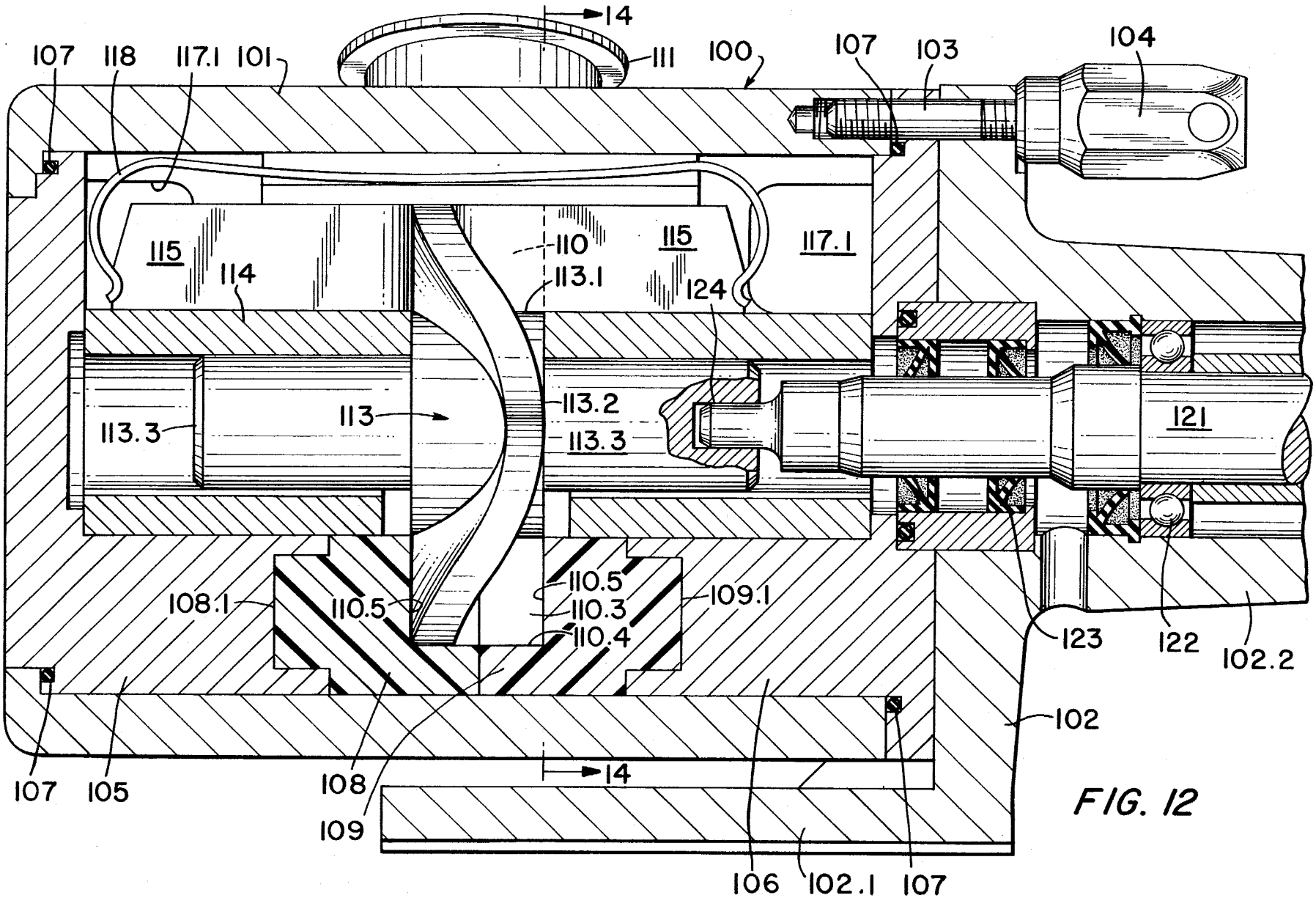
FIG. 12 is a longitudinal section of another embodiment of the invention.
Figure 13:
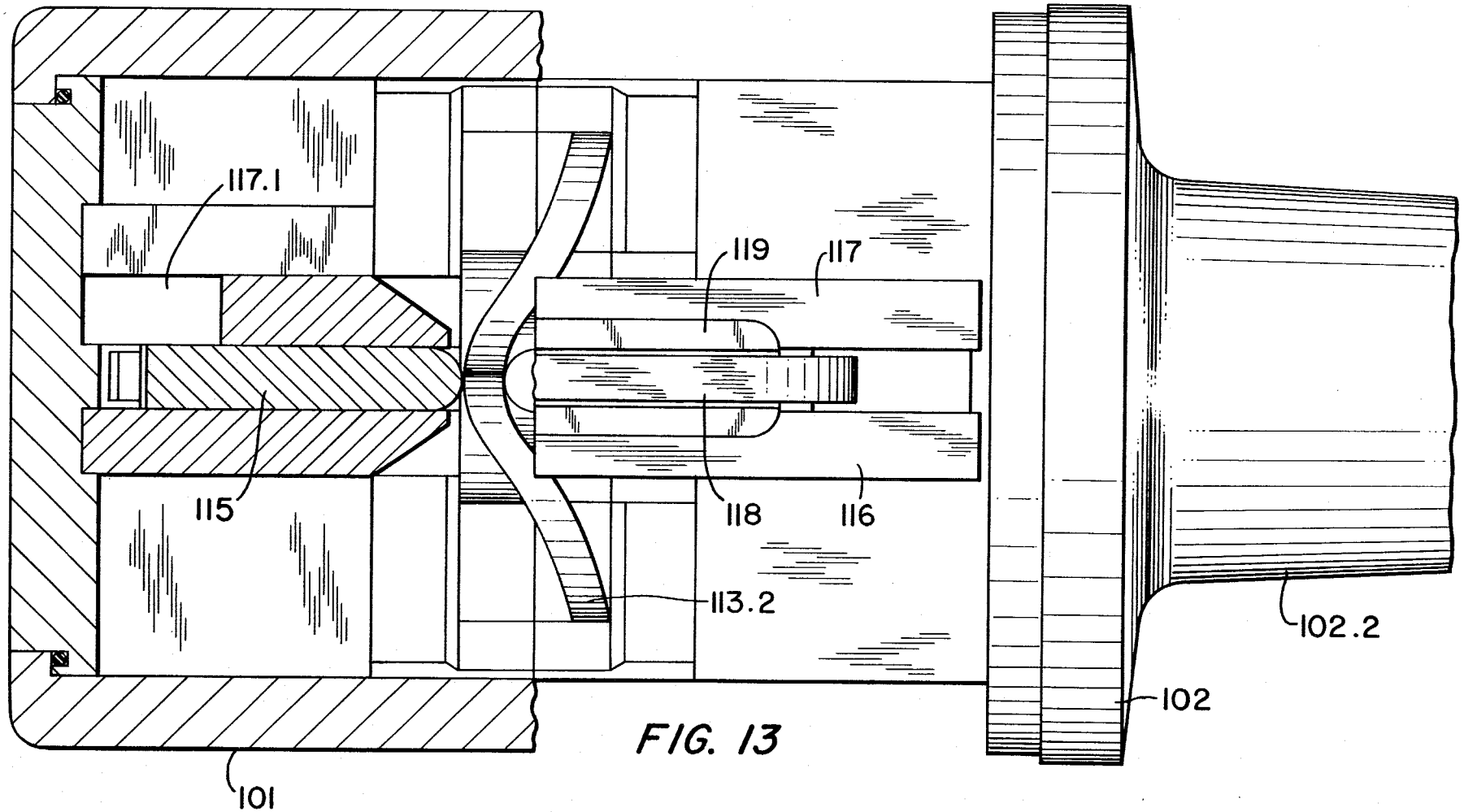
FIG. 13 is a top plan view of the pump shown in FIG. 12 with half of the outer shell or housing removed and with portions shown in section.
Figure 14:
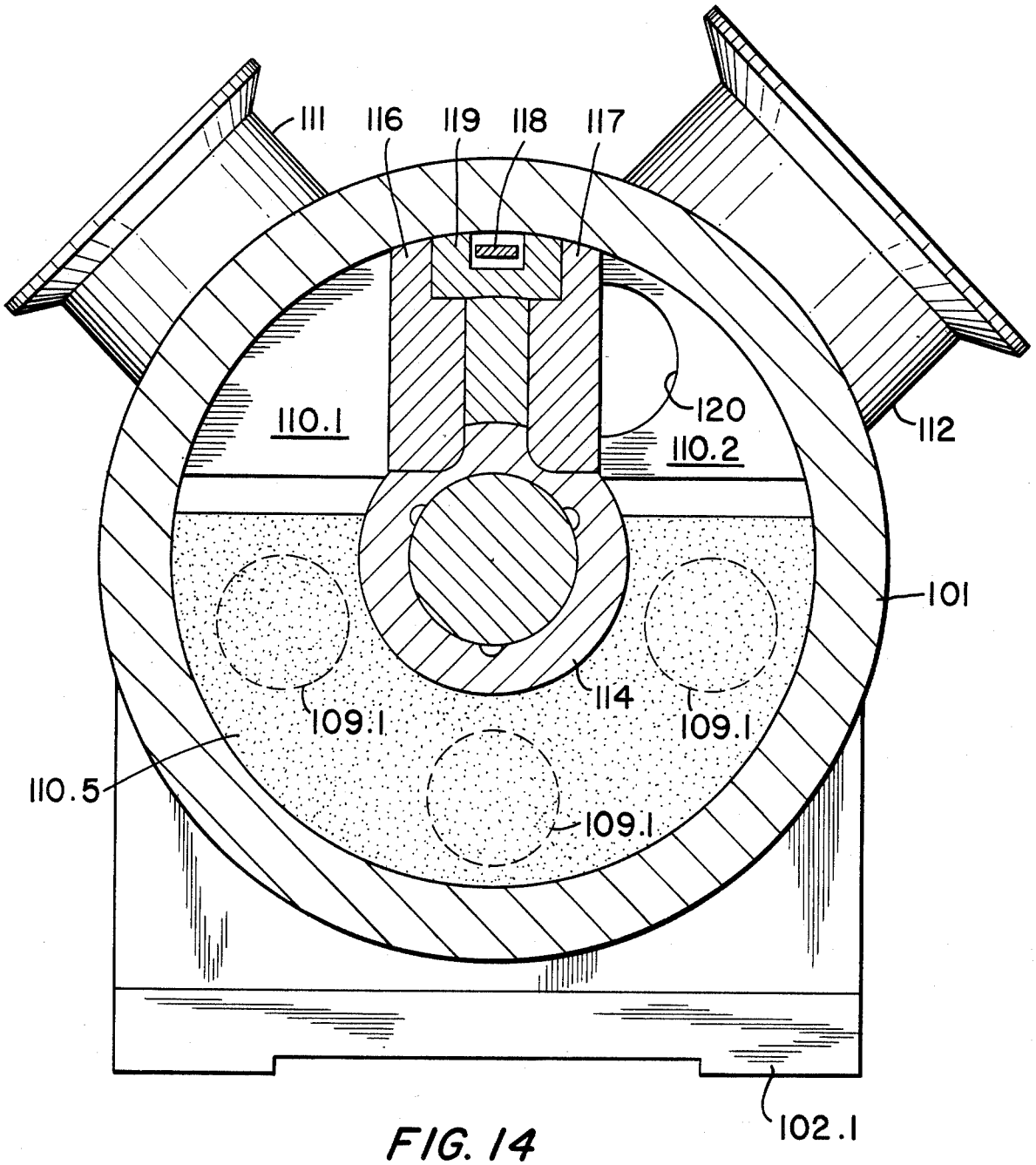
FIG. 14 is a cross section taken approximately on the line 14—14 in FIG. 12.

A further embodiment of the invention shown in FIGS. 12 to 14 comprises a pump 100 having a cylindrical outer shell or housing 101. At one end of the housing 101 there is a removable cover 102 secured to the housing by a plurality of stud bolts 103 only one such bolt and nut being shown in FIG. 12. The cover 102 has an integral foot portion 102.1 by means of which the pump can be mounted on a suitable base or support (not shown).

A rear casing part 105 fits into a rear portion of the cyindrical housing 101 and a front casing part 106 fits into a forward portion of the housing and is secured by the cover 102. Sealing rings 107, for example 0-rings provide fluid tight seals between the casing parts and the housing. Between the rear casing part 105 and front casing part 106 there are two casing liners 108, 109 which are held in position by circular bosses 108.1, 109,1 which fit in recesses provided in casing parts 105, 106 respectively. Since the housing 101, cover 102, casing parts 105, 106 and casing liners 108, 109 are made as separate parts, they can conveniently be of different material. For example the housing 101 may be made of aluminum, steel, stainless steel, alloy or plastic. The cover 102 is conveniently made as a casting or molding for example of iron, aluminum or plastic. The rear casing part 105 and front casing part 106 can, for example, be made of aluminum, steel, stainless steel, alloy or plastic. The material of the casing liners 108.1 and 109.1 is selected in accordance with the material of the rotor (described below) and the fluid which the pump is designed to handle. For example the casing liners may be made of rubber, elastomers, plastic, steel, stainless steel or bronze.

The complementary casing parts 105, 106 together with casing liners 108, 109 define a pump chamber 110 comprising a suction chamber 110.1, a discharge chamber 110.2 and a transport zone 110.3. The transport zone 110.3 defined by the casing liners 108,109 has a cylindrical inner peripheral wall surface 110.4 and opposite planar end walls 110.5. The pump housing 101 is provided with an inlet 111 opening into the suction chamber 101.1 and an outlet 112 opening into the discharge chamber 110.2.

A pump rotor 113 rotatable in the pump chamber comprises a central hub portion 113.1, an undulating vane portion 113.2 projecting radially from the hub and shaft portion 113.3 extending axially from opposite ends of the hub and rotatably received in bearing bushings 114 provided in the casing parts 105, 106. The rotor is coaxial with the inner peripheral surface 110.4 of the transport zone 110.3 and the outer periphery of the vane portion 113.2 of the rotor is in fluid tight sliding contact with the inner periphery of the transport zone. Opposite surfaces of the undulating vane portion 113.2 are smooth, continuous cyclic curves the crests of which are in fluid tight sliding contact with the opposite end walls 110.5 of the transport zone 110.3. As in the case of the rotor illustrated in schematic developed views in FIGS. 10 to 11, there are at least two complete cycles in the circumferential extent of the rotor so that two crests facing in one direction and slidably engageable with one end wall of the transport zone 110.3 alternate with two crests facing in the opposite direction and slidably engageable with the opposite end wall of the transport zone.

Between the suction chamber 110.1 and discharge chamber 110.2 there is provided a gate assembly comprising two sliders or gate members 115 slidable in a direction parallel to the axis of the rotor between two longitudinally extending guide members 116, 117 which are received in, and held in position by, recesses in the casing parts 105, 106 and bushings 114 (FIG. 14). The guide members 116,117 have a width in a direction radial of the rotor somewhat greater than the radial extent of the vane portion 113.2 and are notched to provide passage for the rotor vane portion (FIG. 12). The sliders 115 have a width in a radial direction of the rotor equal to the radial extent of the vane portion 113.2. As will be described more fully below, the sliders 115 have rounded noses 115.1 engageable respectively with opposite sides of the vane portion 113.2 of the rotor and are urged toward the rotor by a bow spring 118 having curved end portions fitted into recesses in the rear ends of the sliders 115. The spring 118 is guidable by an elongate spring guide 119 which fits into elongate recesses in radial outer portions of the spring guides 116,117 and is provided with a longitudinal recess in which the spring 118 is received and guided (FIG. 14). The inner face of the spring guide 119 is in sliding contact with the outer periphery of the vane portion 113.2 of the rotor.

It will be understood that by reason of engagement of the sliders with the undulating surfaces of the vane portion 113.2 of the rotor, a reciprocatory motion will be imparted to the sliders as the rotor rotates. The spring 118 reciprocates with the sliders and continually urges them toward the vane portion of the rotor so as to maintain fluid tight contact therewith. The rotor is so designed, as will be described more fully below, so that the spacing between the sliders remains substantially constant. As the two sliders thus move with one another, the spring 118 is not flexed by reciprocation of the sliders but serves to . overcome frictional, fluid and inertial forces and to compensate for wear.

As the sliders 115 sliding between the guide members 116,117 act in effect as piston pumps with respect to any fluid behind them, the guide member 117 on the side of the discharge chamber is provided with openings 117.1 (FIG. 12) which open into recesses 120 (FIG. 14) in casing parts 105,106 to provide for the ready escape to the discharge chamber of fluid in the space between the guide members 116,117 behind the sliders 115.

The material of the rotor, sliders, guide members and spring guide are selected to provide long and trouble-free operation of the pump. As the rotor is more complex in its configuration than the sliders, the rotor is preferably made of hard, wear-resisting material such as cast steel, stainless steel, alloy or plastic. The material of the sliders 115 is selected so as to minimize wear on the rotor. They may, for example, be formed of carbon, plastic, ceramic or bronze. The material of the spring guide 119 is selected to minimize wear on the rotor, the periphery of which it engages. It may, for example, be cast iron, steel, stainless steel, alloy, plastic, carbon or bronze. The material of the spring is carefully selected so as to maintain the sliders in proper contact with the vane portion of the rotor and also maintain the spring guide 119 in contact with the periphery of the rotor. The spring may for example be formed of cast steel, stainless steel, alloy or bronze.

The rotor is driven in rotation by means of a drive shaft 121 rotatably supported in axial alignment with the rotor by bearings 122 in a projecting portion 102.2 of the cover 102. A fluid tight seal 123 is provided around the drive shaft where it passes through the cover. At the inner end of the drive shaft there is provided a torque-transmitting connection 124 between the drive shaft and one of the shaft portions of the rotor. This is shown by way of example as a flat end on the drive shaft received in a transverse slot in the rotor shaft.

From the drawings and the foregoing description it will be understood that the pump can be disassembled and reassembled easily and quickly. When the nuts 104 are unscrewed, the cover 102 together with the drive shaft 121 can be removed. All of the inner parts of the pump will then slip out of the open end of the housing and will thereupon come apart since they are held together by the housing. This has important advantages. The individual parts can be inspected and worn parts replaced. Thus for example if, by reason of wear, a clearance has developed between the rotor and the casing liners defining the transport zone of the pump chamber, these parts can be replaced so that the pump is again "tight". Moreover by replacing parts with corresponding parts of different material the pump can be converted from one type of service to another. For example metallic casing liners 108, 109 can be replaced by casing liners of an elastic material such as rubber or an elastomer of such dimensions that the distance between opposite planar end surfaces of the transport zone of the pump chamber in relaxed condition is less than the maximum axial dimension of the undulating vane portion of the rotor so that crests of the rotor indent end surfaces of the transport zone. This is referred to as "negative clearance" and is advantageous for pumping low viscosity fluids. When for sanitary or other reasons it is desirable to clean the pump this can be done easily and quickly by reason of the construction of the pump.

Figure 15:
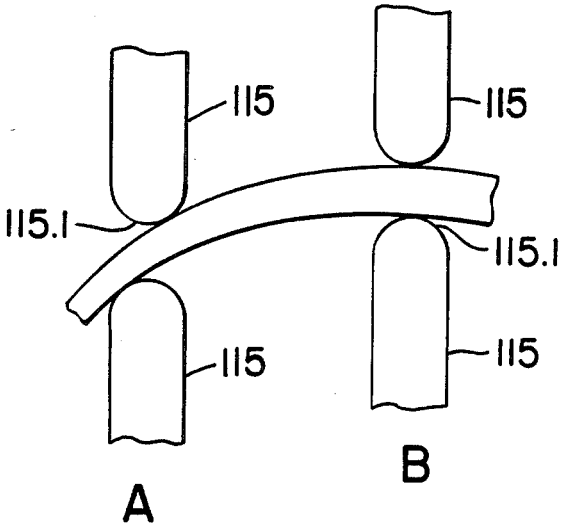
FIG. 15 is a schematic fragmentary view showing two sliders in two different positions with respect to a portion of the undulating vane of the rotor.

Although the pump is simple in overall design the configuration of the undulating vane portion of the rotor is more complex than has heretofore been recognized. This is believed to account for the fact that pumps of this kind have not come into use although they have been proposed more than 100 years ago. While it might be assumed that the vane portion of the rotor could and should be of uniform thickness throughout, this is not the case. Since the angle at which the vane passes between the sliders is continually changing and also varies with the radial distance from the axis the thickness of the vane must be varied in order to maintain a constant spacing of the sliders from one another. This is illstrated schematically in FIG. 15 where it will be seen that the portion of the slider at position A is thinner than the portion at position B although the spacing between the sliders is the same. Whereas FIG. 15 illustrates the vane of the rotor at only one radial distance from the axis, it will be understood that the slope of the vane with reference to a central plane increases as the distance from the axis of rotation decreases.

Figure 16:
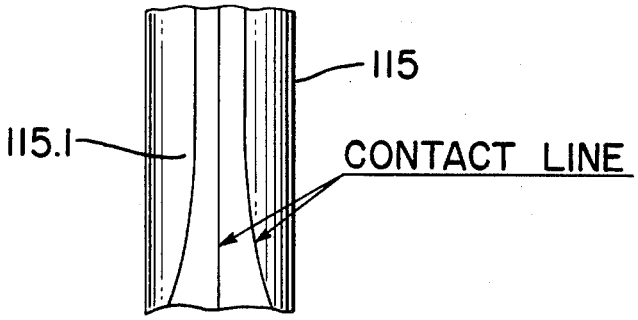
FIG. 16 is a nose view of one of the sliders showing different lines of contact with the rotor.

It will thus be seen that the thickness of the vane of the rotor varies inversely to the slope of the vane surfaces relative to a plane perpendicular to the axis of rotation of the rotor. Moreover, the thickness varies in a radial direction, except at crests of the rotor vane surfaces, in the manner that the thickness increases as the distance from the rotor axis increases. Moreover a further complexity is introduced by reason of the nose of the slider being rounded rather than sharp. As will be seen in FIG. 15 the vane engages the noses of the sliders along their center lines in position B. However, at position A the vane portion of the rotor engages side portions of the noses of the slider. Moreover, the line along which the vane portion of the rotor engages the slider varies in a radial direction. This is illustrated in FIG. 16 which shows different contact lines. At the crests of the undulations, the line of contact between the rotor and slider is a straight line which is radial and perpendicular to the axis of the rotor. At all other positions, the contact line is continually varying. It not only is not perpenicular to the axis of the rotor but moreover is not a straight line but rather a three dimensional curve.

By reason of this the radius of curvature of the nose portions of the sliders is a factor that must be taken into account in determining the varying thickness of the vane portion of the rotor.

Figure 18:
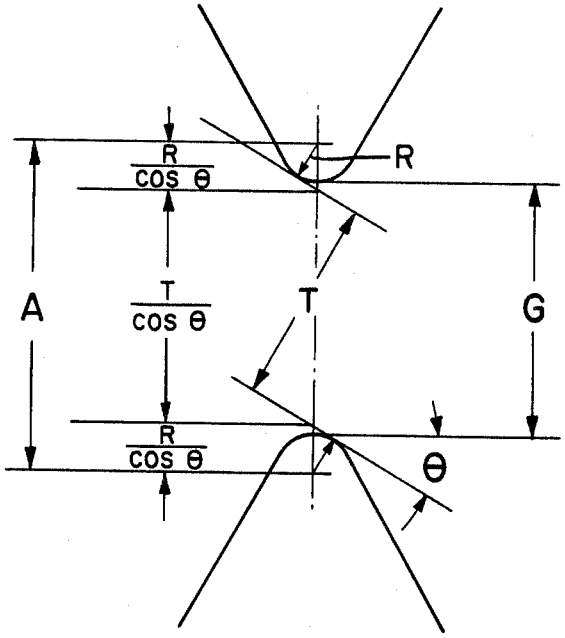
FIG. 18 is a schematic longitudinal section of a pump in accordance with the invention showning certain parameters of an equation defining the rotor surface configuration.

For example in a two inch pump having the following parameters (assuming the curve is,a sine curve):

| | |
|---|---|
| Do — Diameter at hub | 50 mm |
| Di — Diameter at vane tip | 98 mm |
| W — Width between pump chamber walls | 29 mm |
| B — Vane thickness at crests | 8 mm |
| R — Slider nose radius | 1 mm |
| G — Gap between sliders | 8 mm |

then:

$$\theta = \tan^{-1}\frac{(W - B)}{2}\ \frac{4}{2}\cos\alpha$$

$$= \tan^{-1}\frac{42}{D}\cos\alpha$$

$$T = (B + 2R)\cos\theta - 2R$$

$$= 10\cos\tan^{-1}\frac{42}{2}\cos\alpha - 2$$

where:

D is the diameter at specified point, $\theta$ is the angle of vane to the sliders as illustrated in FIG. 18

$\alpha$ is the rotor rotations angle$\times 2$

The following values are obtained:

| | T in MM | | |
|---|---|---|---|
| $\alpha$ | Do = 50 | Dm = 75 | Di = 98 |
| 0 | 5.657 | 6.725 | 7.192 |
| 30 | 6.087 | 6.998 | 7.375 |
| 60 | 7.220 | 7.630 | 7.778 |
| 90 | 8.000 | 8.000 | 8.000 |

Assuming that the wave form of the undulations of the vane portion of the rotor is a sine curve and that there are two wave lengths in the circumference of the rotor the contour of the opposite surfaces of the vane is a function of the angle of rotation of the rotor, the distance of each point from the axis, the amplitude of the wave (distance between walls of pump chamber—-thickness of vane at crests) and the radius of the nose of the sliders. The contour can be produced by a computerized milling machine or profiler which is programmed in accordance with these functions. However, a simple and practical mode of manufacturing the rotor is to mold or cast it to approximate shape and then finish opposite surfaces of the rotor vane by means of a milling cutter or other tool which has a radius equal to the radius of the nose of the sliders. The rotor is mounted on the arbor of the milling machine whereby it can be rotated slowly. The cutting tool in mounted in the machine in a position perpendicular to the axis of the rotor and is reciprocated in an axial direction (while rotating about its own axis) so as to make two complete strokes per revolution of the rotor. The length of each stroke is equal to the amplitude of the wave form to be produced. A correct surface taking into account the radius of curvature of the nose of the slider is thereby produced.

Figure 17A:
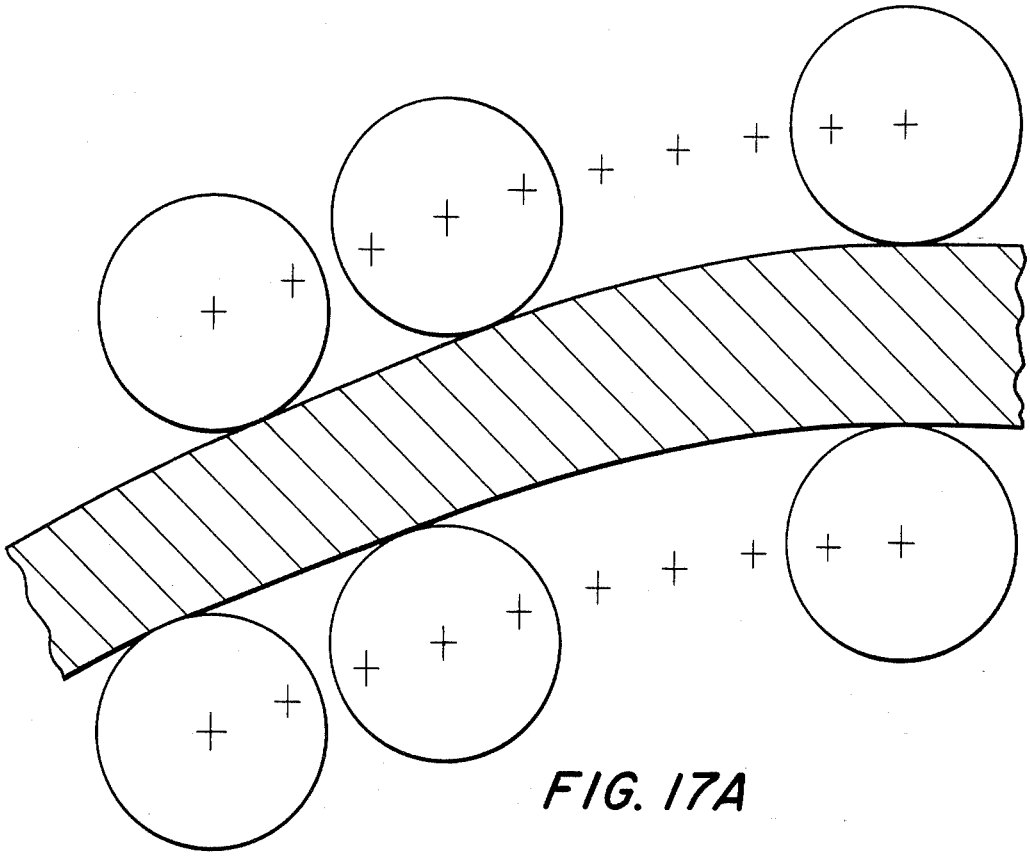
FIGS. 17A and 17B are schematic views illustrating generation of the contour of surfaces of the rotor by means of milling cutters.
Figure 17B:
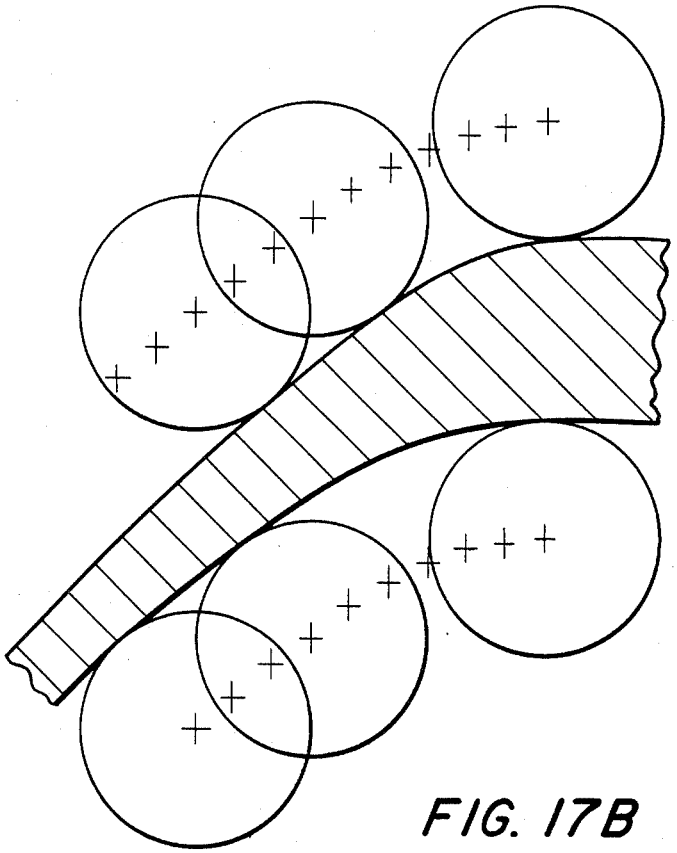

If the milling machine is capable of using two milling cutters suitably spaced from one another both surfaces of the vane can be generated at the same time. This is illustrated schematically in FIGS. 17A and 17B where a portion of the vane of a rotor is designated V and the cutters-shown in different positions with respect to the vane- are designated C. FIG. 17A represents a portion of the vane at its outer periphery while FIG. 17B represents and inner portion of the vane where it will be seen that the slope is steeper. If the miling machine is not capable of operating two cutters simultaneously, the opposite surfaces of the vane can be finished individually, care being taken that the two surfaces are properly oriented with respect to one another.

It will be understood that when a plurality of like pumps is being produced, it is not necessary to machine each rotor in the manner described. When one rotor has been produced in this manner it can be used as a master for producing duplicates, for example, by molding or die casting or by a copying profiler. The cost of production can thereby be reduced.

What we claim is:

1. A rotary fluid pump comprising:

a hollow shell comprising at least two parts which are sufficiently separable from one another to open said shell and means for separably securing said shell parst together in closed condition, complementary casing parts fitting in said shell and defining between them a pump chamber comprising a suction chamber, a discharge chamber and a transport zone extending circumferentially between said suction chamber and said discharge chamber, said transport zone defined by said parts having a cylindrical inner peripheral surface and opposite planar end surfaces, said casing parts being removably insertable in said shell when open and being held in assembed relation to one another by said shell when closed, a rotor rotatably received in said pump chamber, said rotor comprising a hub portion and an undulating vane portion projecting radially outwardly from said hub portion and having an outer periphery slidable engaging said inner peripheral surface of said transport zone of said pump chamber and opposite surfaces which in a circumferential direction are smooth, continuous cyclic curves with at least two complete cycles in the circumferential extent of said rotor, crests of said curves slidably engaging opposite planar end surfaces of said pump chamber, gate means separating said suction chamber from said discharge chamber and comprising a pair of gate members slidable longitudinally in guide channels and having rounded nose portions engaging respectively opposite faces of said undulating vane portion of the rotor, and spring means interconnecting said gate members with one another and biasing them toward said undulating vane portion, said vane portion of the rotor having a thickness which varies in a circumferential direction and in a radial direction to provide constant line contact with said rounded nose portions of said gate members throughout the radial extent of said vane portion as said rotor rotates, and inlet and outlet openings in said shell communicating respectively with said suction chamber and discharge chamber.

2. A rotary fluid pump according to claim 1, in which said nose portions of said gate members, in a cross section parallel to the axis of rotation of said rotor, are arcuate with a predetermined radius of curvature and in which said opposite surfaces of said vane portion of said rotor are surfaces with a contour that would be generated by rotary cutters rotatable about axes perpendicular to the axis of rotation of the rotor, having a radius equal to the radius of curvature of said nose portions and reciprocated cyclically in a direction axial of said rotor in timed relation with the rotation of the rotor.

3. A rotary fluid pump according to claim 1, in which said hub portion of said rotor has shaft portions projecting axially thereof and rotatably received in bearings in said casing parts, one of shaft portions having means for driving said rotor in rotation.

4. A rotary fluid pump according to claim 1, in which said shell comprises a cylindrical portion open at an end, a closure for said end and means for securing said closure to said cylindrical portion, said casing parts, rotor and gate means being insertable into said cylindrical portion through said open end and being retained therein, after insertion, by said closure, whereupon said casing parts rotor and gate means are held in assembled relation by said cylindrical portion and said closure of said shell.

5. A rotary fluid pump according to claim 4, in which said hub portion of said rotor has shaft portions projecting axially thereof and rotatably received in bearings in said casing parts, and in which a drive shaft extends through and is rotatably supported by said closure in axial alignment with said hub, said drive shaft and one of said shaft portions of the rotor having interfitting drive portions for transmitting torque between said drive shaft and said rotor.

6. A rotary fluid pump according to claim 1, in which said gate means comprises two elongate guide members received in recesses defined by said casing parts and spaced apart to receive said gate members slidably between them and a spring guide positioned between said guide members radially outwardly of said gate members, and in which said spring means comprises a leaf spring guided by said guide members and said spring guide and having in-curved ends engaging said gate members respectively.

7. A rotary fluid pump according to claim 6, in which an opening in one of said guide members provide communication between said discharge chamber and the space between said guide members rearwardly of said gate members.

8. A rotary fluid pump according to claim 1, in which at least portions of said casing parts defining said transport zone of said pump chamber are of elastomeric material.

9. A rotary fluid pump according to claim 6, in which parts defining opposite planar end surfaces of said transport zone are of yieldable elastomeric material and in which the distance between said opposite planar end surfaces of said transport zone of said pump chamber in relaxed condition of said parts is less than the maximum axial dimension of said undulating vane portion of said rotor, whereby said crests of said curves indent said end surfaces of said trnasport zone.

10. A rotary fluid pump comprising a pump casing having a pump chamber comprising a suction chamber, a discharge chamber and a transport zone extending circumferentially between said suction chamber and said discharge chamber, said transport zone having a cylindrical inner peripheral surface and opposite planar end surfaces, a rotor rotatably received in said pump chamber and comprising a hub portion and a undulating van portion projecting radially outwardly from said hub portion and having an outer periphery slidably engaging said inner peripheral surface of said transport zone of said pump chamber and opposite surfaces which in a circumferential direction are smooth, continuous cyclic curves with at least two complete cycles in the circumferential extent of said rotor, crests of said curves slidably engaging opposite planar end surfaces of said pump chamber, gate means separating said suction chamber from said discharge chamber and comprising a pair of gate members slidable longitudinally in guide channels and having rounded nose portions engaging opposite faces of said undulating vane portion of said rotor, and spring means interconnecting said gate members with one another and biasing them toward said undulating vane portion of the rotor, and inlet and outlet opening in said casing communicating respectively with said suction and discharge chambers, said nose portions of said gate members in cross section parallel to the axis of rotation of the rotor being arcuate with a predetermined radius of curvature and opposite surfaces of said vane portion of said rotor being surfaces with the contour of a surface generated by a cylindrical rotary cutter rotatable about an axis of rotation perpendicualr to the axis of rotation of the rotor, having a radius equal to the radius of curvature of said nose portions of said gate members and reciprocated cyclically in a direction axial of said rotor in timed relation with the rotation of the rotor, the thickness of said vane portion of said rotor varying inversely to the slope of said surfaces with respect to a plane perpendicular to the axis of rotation of said rotor and, except at crests of said surfaces, varying directly with the radial distance from said axis of rotation of said rotor.

11. A rotary fluid pump comprising a pump casing having a pump chamber comprising a suction chamber, a discharge chamber and a trnasport zone extending circumferentially between said suction chamber and said discharge chamber, said transport zone having a cylindrical inner peripheral surface and opposite planar end surfaces, a rotor rotatably received in said pump chamber and comprising a hub portion and an undulating vane portion projecting radially outwardly from said hub portion and having an outer periphery slidably engaging said inner peripheral surface of said transport zone of said pump chamber and opposite surfaces which in a circumferential extent of said rotor, crests of said curves slidably engaging opposite planar end surfaces of said pump chamber, gate means separating said suction chamber from said discharge chamber and comprising a pair of gate members slidable longitudinally in guide channels and having rounded nose portions engaging opposite faces of said undulating vane portion of said rotor, and spring means interconnecting said gate members with one another and biasing them toward said undulating vane portion of the rotor, and inlet and outlet openings in said casing communicating respectively with said suction and discharge chambers, said rounded nose portions of said gate members in cross section parallel to the axis of rotation of the rotor being arcuate with a predetermined radius of curvature and said vane portions of the rotor having a thickness which varies in a circumferential direction and in a radial direction to provide constant line contact with said rounded nose portions of said gate members throughout the radial extent of said vane portion as said rotor rotates, the thickness of the rotor vane portion at each location being defined by the equation:

$$T=(B+2R)\cos\theta-2R$$

where $$\theta = \tan^{-1}\frac{(W-B)}{2}\ \frac{4}{2\cos\alpha}$$

and where

B is the vane thickness at crests of the vane

R is the gate member nose radius

W is the distance between planar end surfaces of the pump chamber $\alpha$ is the rotor rotation angle$\times$2.

* * * * *